United States Patent [19]

Selinko

[11] 4,390,198

[45] Jun. 28, 1983

[54] MOLDED MULTIFUNCTION LATCH MECHANISM

[75] Inventor: George J. Selinko, Lighthouse Point, Fla.

[73] Assignee: Motorola, Inc., Schaumburg, Ill.

[21] Appl. No.: 153,662

[22] Filed: May 27, 1980

[51] Int. Cl.[3] ..... E05C 1/04

[52] U.S. Cl. ..... 292/152; 292/DIG. 38; 292/DIG. 53

[58] Field of Search ..... 292/152, 175, DIG. 53, 292/DIG. 38, 209

[56] References Cited

U.S. PATENT DOCUMENTS

| | | | |
|---|---|---|---|
| 887,591 | 5/1908 | Cook | 292/209 X |
| 3,612,590 | 10/1971 | Andreini et al. | 292/DIG. 53 X |
| 3,630,558 | 12/1971 | Andreini et al. | 292/DIG. 53 X |
| 3,806,175 | 4/1974 | Van Herpen | 292/147 |
| 3,850,464 | 11/1974 | Bisbing et al. | 292/DIG. 38 X |
| 4,022,504 | 10/1977 | Anderson | 292/DIG. 38 X |
| 4,223,787 | 9/1980 | Lowry et al. | 292/175 X |
| 4,231,597 | 11/1980 | Pelcin | 292/147 X |

*Primary Examiner*—William E. Lyddane

*Attorney, Agent, or Firm*—Donald B. Southard; James W. Gillman; Edward M. Roney

[57] ABSTRACT

A single molded plastic part forms the actuator, the latching beam and the retainer for holding the latch mechanism in position, and also provides detented open and closed positions. The latch mechanism can be used with the door or closure for an opening in a housing, such as the battery door for a small portable electronic device. The one-part latch has an actuating button on one side of the door which cooperates with resilient retainer tabs to hold the latch in movable engagement with the door. An integral latching beam may extend on the other side of the door and be movable to a position to latch the door. Indentations on the beam, or on another part of the latch, can cooperate with a detent cam to hold the latch mechanism in released or open, and latched or closed positions. The latch mechanism can be either slidably or rotatably movable for the latching operation.

7 Claims, 9 Drawing Figures

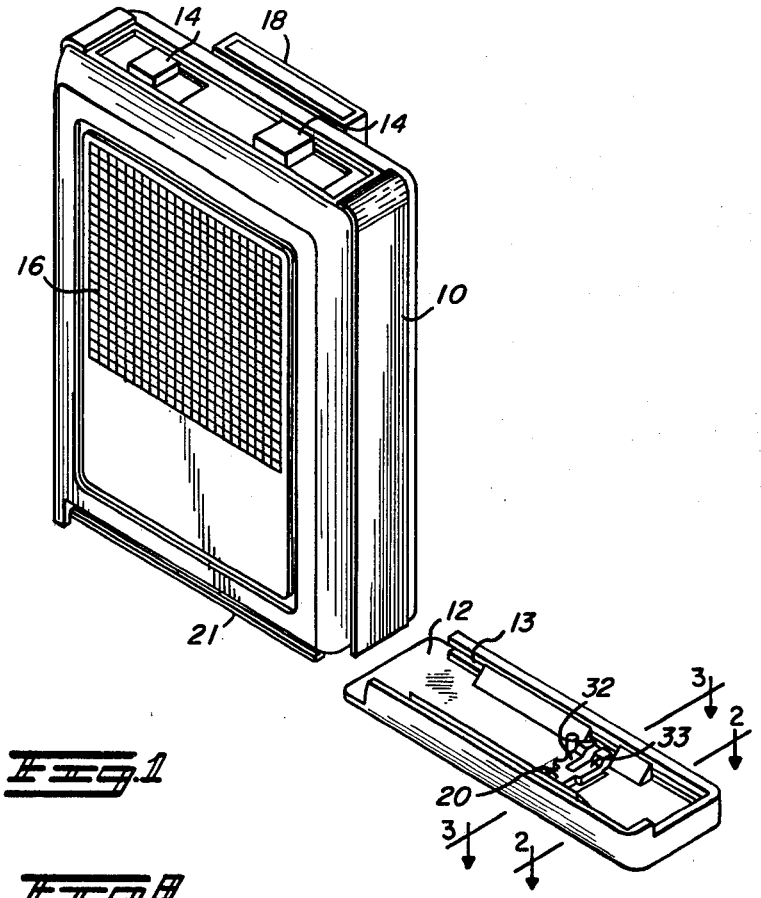
Fig. 1
Fig. 8
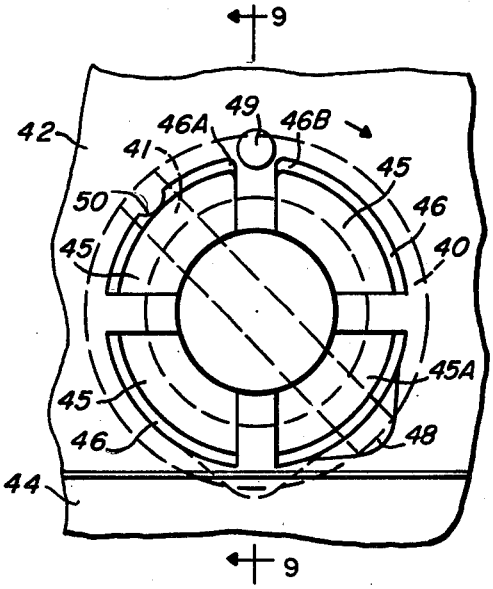
Fig. 9
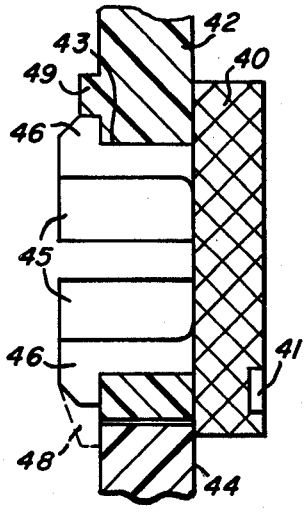

MOLDED MULTIFUNCTION LATCH MECHANISM

BACKGROUND OF THE INVENTION

Portable electronic devices are commonly energized by a battery which is placed within the housing of the device. To provide access to the battery, an opening is provided in the housing with a door or other closure for the same. In small devices, such as a radio pager, a plastic housing may be used, and the door may also be formed of plastic. However, it is important that the housing be rugged as these devices are subjected to rough usage, and the door must not open accidentally when the device is dropped or encounters severe shocks in other ways. Various integral latching arrangements have been used, but these are not sufficiently rugged for many applications.

Although strong latches are known which may be used on a door, these have not been entirely satisfactory. In some cases, the latches are objectionably large and are formed of a number of separate parts resulting in excessive costs for the manufacture and assembly of the parts. Also, some latches have actuators which protrude objectionably and may be accidentally released.

SUMMARY OF THE INVENTION

It is an object of this invention to provide a simple one-piece latch mechanism which may be used with the door or closure of a housing for a small portable electronic device.

Another object of the invention is to provide a one-piece latch having an actuator on one side of a door and an integral latching beam or projection on the opposite side which is movable to latch the door.

A further object of the invention is to provide a one-piece molded latch for use on a molded door, wherein the latch has integral resilient tabs for engaging the door to hold the latch thereon, with the latch being slidable or rotatable with respect to the door to hold the same in closed position.

A still further object is to provide a molded latch which includes integral actuating and latching portions with indentations on one portion cooperating with a detent cam to hold the latch in released and latched positions.

In accordance with the invention, a one-piece molded plastic latch mechanism is adapted for use with a door or closure for an opening in a housing for a portable electronic device, such as the door for a battery opening. The latch mechanism includes an actuator operated from the outside of the housing, a coupling portion extending through an opening in the housing and a latching portion on the inside. Integral resilient tabs hold the mechanism in movable relation on the housing. The mechanism can be slidable in a slot in the housing to move a beam into latching position, or can be rotatable to move a projecting lip into latching position. Detent indentations can be provided on the beam, or on some other part of the one-piece mechanism, which cooperate with a detent cam to hold the latch mechanism in either released or open position, or in latched or closed position. The latch mechanism can be secured to the door of a housing to engage a fixed part thereof for latching the door closed, or can be secured to another part of the housing to engage the door to latch the same.

BRIEF DESCRIPTION OF THE DRAWINGS

FIG. 1 is an exploded perspective view of a paging receiver utilizing the latch mechanism of the invention;

FIGS. 8 and 9 illustrate a second embodiment of the latch mechanism of the invention.

DETAILED DESCRIPTION OF THE INVENTION

Figure 2:
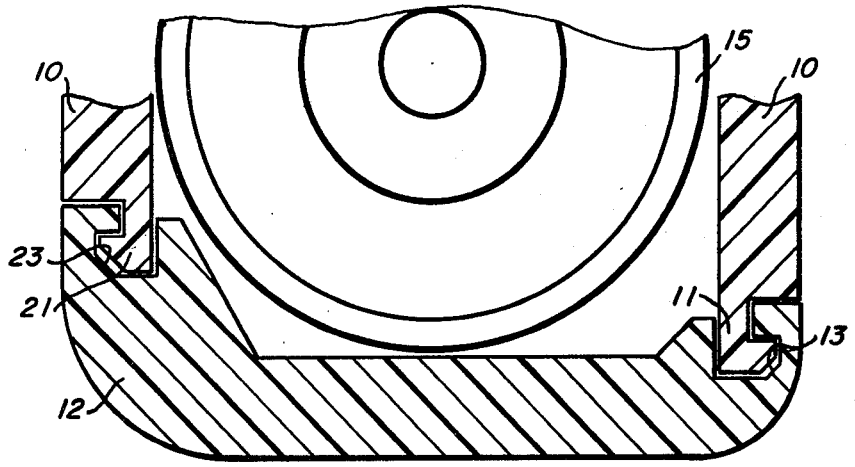
FIGS. 2 and 3 are cross-sectional views along the lines 2—2 and 3—3 of FIG. 1.

FIG. 1 shows a portable electronic device, such as a radio pager, which includes the latch mechanism of the invention. This includes a housing 10 having a removable battery door or cover 12. The pager may have controls 14 at the top and a grille 16 on the front for the passage of sound. A clip 18 may be provided on the back of the housing 10 for holding the pager on a belt or the like, as is well known. The battery door 12 slidably engages the bottom of the housing 10, having grooves 13 and 23 therein (FIG. 2) for receiving projecting ribs 11 and 21 extending at the bottom of housing 10. A latch member 20 holds the door 12 in closed position on the housing.

Figure 3:
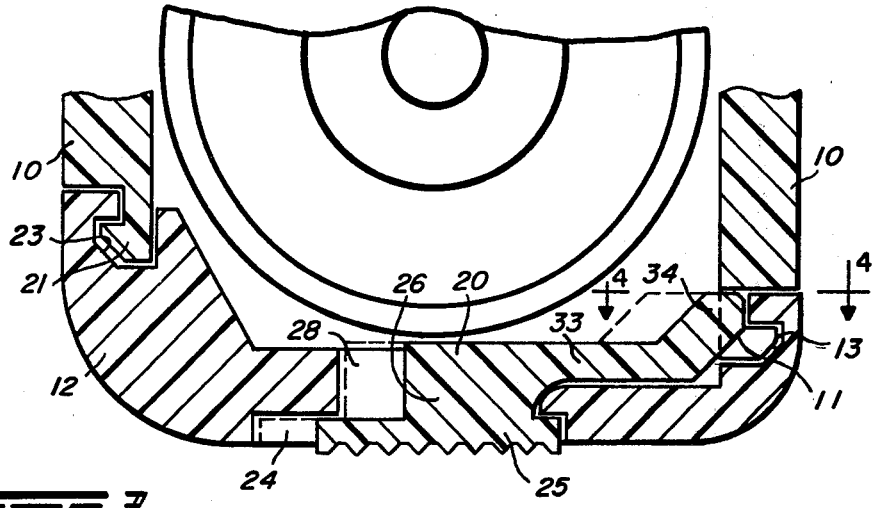

FIGS. 2 and 3 show more in detail the engagement between the door 12 and the bottom of the housing 10. This housing has an L-shaped lip 11 on the bottom at the back (right side in FIG. 2) which is slidably received in the groove 13 of the door 12. A similar lip 21 extends from the front of housing 10 (left side in FIG. 2) which is slidably received in groove 23 of the door 12. As has been stated, the door or cover 12 may enclose a battery, indicated by numeral 15 in FIG. 2. The door 12 can be slidably removed from housing 10 to permit removal and replacement of the battery.

Figure 4:
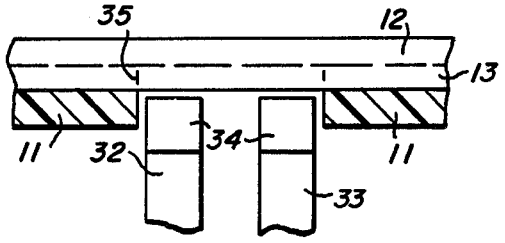
FIG. 4 is a fragmentary view along the line 4—4 of FIG. 3 showing the cooperation of the latch with the housing.
Figure 5:
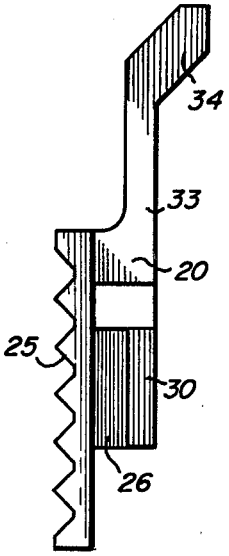
FIGS. 5, 6 and 7 illustrate the latch mechanism in more detail.
Figure 6:
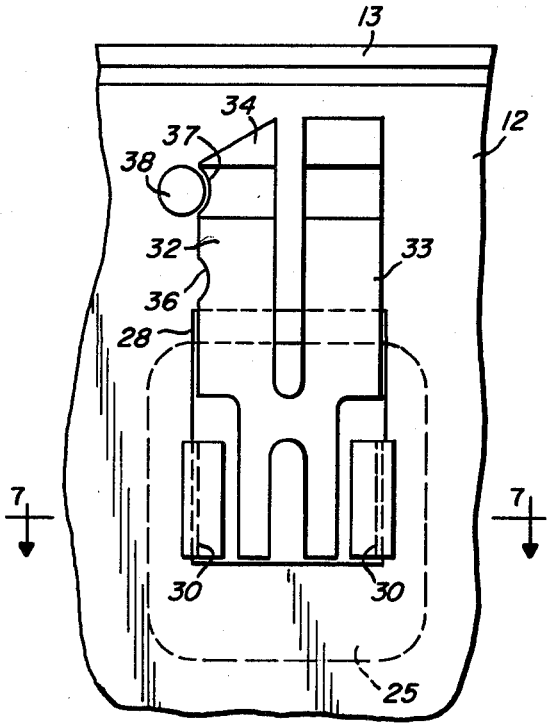
Figure 7:
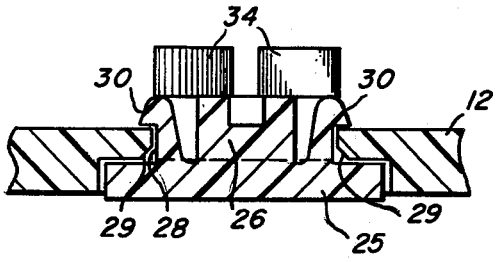

FIG. 3 shows the latch member 20 in position in the door 12, and this member is shown in more detail in FIGS. 5–7. The member 20 is a one-piece molded part which includes an actuator 25 on the outside of door 12 for operating the latch. The actuator 25 is positioned in a recess 24 in door 12 so that it does not protrude from the housing, and may have ribs along the exposed surface to facilitate moving the same. Connected to the actuator 25 is a coupling or body portion 26 which extends through a slot 28 in the door 12. The portion 26 has integral resilient retainer tabs 30 thereon which engage the inside of door 12, as best shown in FIG. 7. The tabs 30 will flex to permit insertion of the latch member onto the door 12, with slanting edges 29 on the sides of slot 28 facilitating such action. Connected to the portion 26 of the latch member 20 are two beams 32 and 33. These beams are molded integrally with the actuator 25 and body portion 26, and extend along the inside of door 12. The beams 32 and 33 having angularly extending ends 34 which extend into a notch 35 cut in the lip 11 of the housing 10 to block sliding movement of the door 12 with respect to the housing 10. FIG. 4 shows the ends 34 of the beams 32 and 33 positioned in the notch 35 cut in the lip 11.

The beam 32 has two indentations 36 and 37 along one side thereof positioned to cooperate with a detent cam 38 on the door 12 (FIG. 6). The indentation 37 engages cam 38 when the actuator is in open or released position, as shown in FIG. 6. When the latch member is moved forward to the latching or closed position, the beam 32 will flex so that the indentation 37 is moved past the cam 38 and the indentation 36 engages this cam. Thus the latch member 20 is detented in both the open or released position, and also in the latched or blocking position. FIG. 3 shows the latch member 20 in blocking position by solid lines and in released position by dotted lines.

FIGS. 8 and 9 illustrate a second embodiment of the latch mechanism of the invention which is adapted for rotary movement. The actuator 40 is provided on the outside of a door 42 for a housing 44. If desired, the actuator can be provided in a recess in the door so that it will not protrude. The actuator 40 can have a slot 41 in the exposed surface thereof to facilitate operation of the same. Connected to actuator 40 are a plurality of resilient coupling segments 45 which extend through an opening 43 in the door 42. The segments 45 have outwardly extending retainer tabs or ribs 46 which engage the inside of door 42 to hold the latch member assembled thereto. The segments 45, are resilient, and spaced from each other, and will flex to allow insertion of the latch member through the opening 43 in the door 42.

As shown in FIGS. 8 and 9, one of the segments 45, which is designated 45A, has a projecting lip 48 which extends outwardly from the rib 46. When the actuator 40 is rotated clockwise to the dotted position (FIG. 8), the lip 48 will extend beyond the edge of the door 42 to engage the housing 44. Thus the lip 48 forms a latch which holds the door in fixed position with respect to the housing.

As in the prior embodiment, the latch mechanism of FIGS. 8 and 9 is detented in both the released and latching positions. A detent cam 49 is provided on the door 42 and is positioned with respect to the edges 46A and 46B of ribs 46 to provide detent action when the latch is in open position. An indentation 50 is provided on the rib 46 opposite to lip 48, which cooperates with the cam 49 to provide detent action when the latch mechanism is in the latched position. It will be noted that a 45° rotation of actuator 40 will operate the latch between the released and actuated positions.

Although the latch mechanism has been illustrated as positioned on a door of a housing, it will be obvious that the mechanism described can be positioned on the fixed part of a housing to latch a door, or can be used in many applications to latch one relatively movable element with respect to another. As the latch is provided by a single part which forms many functions, it can be produced at small cost. It can also be made of a size for use on small housings and still it provides a very secure latch which is detented so that it is not easily accidentally released.

I claim:

1. A one-piece springless fingerlike latch mechanism for use on a portable, hand-held device having a housing and a door movable in relation thereto and wherein the door is slidable between first and second positions and has an opening therein, such latch mechanism including in combination:

an actuating portion on one side of the slidable door for operating the latch mechanism in lateral rectilinear movement;

a coupling portion connected to said actuating portion and extending through the opening in the slidable door, and said coupling portion having resilient ribs engaging the opposite side of the slidable door for holding the latch mechanism in said rectilinearly movable relation on the slidable door; and a springless latching portion formed integrally with said actuating portion and said coupling portion, and laterally slidable by said actuating portion between a first set released position and a second set latched position engaging the housing.

2. The structure of claim 1 wherein said latch mechanism has portions cooperating with the slidable door forming detents which define the set released and set latched positions.

3. The structure of claim 1 wherein said latching portion extends from said coupling portion and is on the opposite side of the slidable door.

4. The structure of claim 1 wherein said coupling portion is rectilinearly slidable in the opening of the slidable door, and said latching portion is a latch beam adapted to engage the housing.

5. The structure of claim 4 wherein said latch beam has indentations therein forming detents for holding the latch mechanism in released and latched positions.

6. A door and latch combination for a portable, hand-held device including in combination:

a door slidably movable between first and second positions and having a relatively flat portion with an opening therein; and a one-piece springless latch member laterally slidable in rectilinear movement within said opening and having an integral actuating portion on one side of said door and an integral fingerlike latching portion on the opposite side of said door, wherein said door has a detent cam thereon, and said fingerlike latch member has portions cooperating with said cam to hold said latch member in first set released and second set latched positions.

7. The structure of claim 6 wherein said fingerlike latch member has integral resilient retainer tabs engaging said opposite side of said slidable door cooperating with said actuating portion to hold said latched member in a laterally slidable relation on said door.

* * * * *